US005639983A

United States Patent [19]

Faughn

[11] Patent Number: 5,639,983

[45] Date of Patent: Jun. 17, 1997

[54] HOLDER FOR PRIMERS AND TOOLS

[75] Inventor: Jim A. Faughn, Bel Air, Md.

[73] Assignee: The United States of America as represented by the Secretary of the Army, Washington, D.C.

[21] Appl. No.: 514,882

[22] Filed: Aug. 14, 1995

[51] Int. Cl.[6] ..... F41A 35/00

[52] U.S. Cl. ..... 89/34; 42/90

[58] Field of Search ..... 89/34, 37.07, 37.13, 89/40.01, 40.02, 40.07, 40.08; 42/90, 71.01

[56] References Cited

U.S. PATENT DOCUMENTS

| | | | |
|---|---|---|---|
| 2,298,678 | 10/1942 | Chase | 42/90 |
| 4,589,220 | 5/1986 | Lofland | 42/90 |
| 5,121,564 | 6/1992 | Story | 42/90 |
| 5,133,258 | 7/1992 | Rock et al. | 102/331 |
| 5,265,365 | 11/1993 | Finn | 42/74 |
| 5,544,441 | 8/1996 | Mahn et al. | 42/106 |

*Primary Examiner*—Michael J. Carone
*Assistant Examiner*—M. J. Lattig
*Attorney, Agent, or Firm*—Freda L. Krosnick; William E. Eshelman

[57] ABSTRACT

A primer and tool holder is configured for mounting on an artillery piece by a coupling which projects at a downward angle from the holder and is received in a trunnion mount tunnel on the artillery piece. The coupling has a wedge lock which is received in the tunnel and is secured by a wedge lock expanded by advancing a cam. An primer carrier or tray having a plurality of holes therein stores individual primers in the holes with the ends of the primers being readily accessible to the artilleryman. The base has a plurality of storage tubes fixed thereto for receiving tools such as a spit-hole brush, a vent hole reamer, a primer chamber brush and a spit-hole drill. The base also has a cam latch proximate the lower end thereof for fastening the lower end of the primer and tool holder to a drain hole. An alternate embodiment includes straight walled through holes drilled at a 10°–15° angle above horizontal to retain the primers. The article carrier may be articulated to pivot between 1) a stowed position substantially parallel to base and 2) an operational position substantially perpendicular to base. A locking mechanism may lock the tray in the stowed and operational positions and is connected to the holder by a tether. A cover is provided for covering the primer and tool holder when not in use to protect the primers and tools from the elements.

12 Claims, 6 Drawing Sheets

HOLDER FOR PRIMERS AND TOOLS

GOVERNMENTAL INTEREST

The invention described herein may be manufactured, used and licensed by the Government of the United States of America without payment to the inventor named herein of any royalty thereon.

BACKGROUND OF THE INVENTION

1. Field of the Invention

This invention generally pertains to military weapon systems; guns, field artillery cannons, howitzers, etc. and more specifically addresses any cannon or gun requiring the use of a primer for primary charge detonation and/or cleaning tools associated with the firing mechanism for the primers.

2. Description of the Prior Art

The firing of field artillery weapons (reference the M198 towed howitzer, M109 series self propelled howitzers, the M110 series of heavy howitzers, and the M107 howitzer) requires several steps to prepare the cannon for firing. The aforementioned artillery pieces all fire a semi-fixed powder charge, meaning the projectile and the powder charge are separate components. To fire the weapon, a projectile must be rammed into the cannon tube and seated into the rifling lands and grooves. Next, the propelling (powder) charge is placed into the powder chamber of the breech, and the breech block is closed. The final preparatory step before firing the cannon, is to open the firing mechanism on the breech block and insert the primer (a small shotgun like cartridge) into the firing mechanism and then close it. To fire the cannon, the number one cannoneer pulls the lanyard attached to the firing mechanism, which strikes a firing pin into the primer initiating its charge. This explosive shot travels down the vent hole ("spit hole") of the breech block and strikes the rear of the propelling charge, in turn initiating combustion of the main charge.

The artilleryman or cannoneer is issued a "belt, primer" -nsn 1025.00.860.5446, which is used to carry the primers in a gun belt fashion. Typically, the cannoneers do not use the belt because of difficulty in inserting and extracting the primers in an expedient manner. The primers are more commonly carried in various unorthodox places by the discretion of each cannoneer. Some of the locations primers have been stored are listed below:

a. The primer's individual vapor barrier pouches are opened and then the primers are strewn about in their fiber board container, and laid somewhere on the cannon. As the gun fires, the vibration can cause the box to move and fall off the cannon, spilling the primers onto the ground, (witnessed on the M198).

b. Placed in the primer belt but slung over various places on the cannons, on trunnions, trails, or just about any nearby protuberance of the cannon, (witnessed on the M198).

c. Stuck in the elastic helmet cover band, (witnessed on the M198 and M109).

d. Stuck in the mouth of the cannoneer, (witnessed on the M198).

e. Loosely stored in oddment trays around the bustle, (witnessed on the M109).

f. Stuck between the aluminum ceiling and the ceiling light. Safety Note: The ceiling light is operated by 24 volt electricity, (witnessed on the M109).

g. Carried in the cannoneer's pockets, (witnessed on the M198).

h. Stuck between the fingers of the cannoneer, (witnessed on the M198).

As one can see, the ingenuity and resourcefulness of the soldier is limitless. However, this non-standardized way of storing the primers causes severe problems while firing the weapon for the cannon crews. The cannoneer must locate the primer, acquire it, orient it, and insert it into the firing mechanism as rapidly as he can. When the primers are strewn about in various orientations and locations, it can take additional critical seconds to locate and manipulate the primers for insertion into the firing mechanism. When crew members rotate positions or must fill in missing positions, the storage of the primers becomes very critical, if everyone stores them in a different place or manner, the new cannoneer must find them before the cannon can be made operational. This time delay could be catastrophic during combat missions.

In addition to the above mentioned problems, when the soldiers are in Mission Oriented Protective Posture (MOPP IV), the operation becomes even more difficult to perform. The MOPP IV ensemble degrades tactile feel and the ability to grasp small objects, limits the soldier's vision, adds mental and physical stress to even the most simple jobs, and in general, encumbers all functions to some degree. The primer belt and canteen straps can impede the performance of MOPP IV operations and many soldiers elect not to wear them, also this eliminates any chance of "snagging" on breech blocks, handles, etc. During an ARL study, "Evaluation of the Effect of Protective Clothing on the Ability of Self-propelled Artillery (M109) Crews to Conduct and Sustain High Firing Rate Missions," the degradation of the ability to locate, acquire, orient, and insert the primers was witnessed.

SUMMARY OF THE INVENTION

A field expedient device is provided which in accordance with the present invention locates primers in a convenient and readily accessible location. This device has been proven very successful in that the firing rate of the crew utilizing this device was 21% faster than other crews in the study. The device has eliminated the "fumble and search" time and fostered more efficient firing rates. This device was the impetus for a follow-on design for the M198 cannon which is described in greater detail henceforth.

In a further study, "Assessment of Towed Artillery (M198) Crew Performance in NBC Protective Clothing," a device according to the present invention was designed, built, and tested. This prototype device holds the M82 primers in a readily accessible and convenient place for the cannoneer to locate, acquire, orient, and then insert the primer into the firing mechanism. The device attaches onto either trunnion mount of the M198 via means of the trunnion mount bearing tunnel and the trunnion mount drain hole. The portion of the device which mounts in the bearing tunnel is a unique device which when tightened down, spreads opposing legs which abut and grip the interior walls of the tunnel and apply downward pressure to the tunnel floor as well. The device is secured at the bottom by a simple toggle bolt assembly which slips into the hole and then pivots its leg to rest on the inside wall of the trunnion, a threaded bolt attached to this leg passes through the device mounting plate. The base plate is held against the exterior wall of the trunnion by tightening down a nut on the threaded shaft of the toggle bolt. The primers are held in a non-conductive material which is mounted normal to the base plate of the device, and are spaced to allow easy access by gloved hands for NBC and Arctic operations.

Another advantage of storing the primers in the device, is that the chief-of-section can immediately inventory the rounds fired and rounds remaining by quickly glancing at the primers left in the holder plate. This has proven to be an asset in terms of safety and mission effectiveness; inventory control of the expended rounds.

In addition to the problem of locating, acquiring, orienting, and inserting the primers, the cannoneer has another task which must be accomplished for safe and effective operation of the cannon. He must periodically clean the firing mechanism and the vent tube ("spit hole") to remove powder residue which can cause failure of the firing mechanism and closure of the "spit hole", rendering the weapon inoperable. Tools are provided for the cannoneer to accomplish this task. However, no storage capabilities are provided, and thus the soldier is left to his own "ingenuity and resourcefulness" to store them near his duty station. The lack of an appropriate and designated location for storage of these tools results in a similar disarray, as with the primers, and consequently mission effectiveness is degraded. However, the present invention solves this problem by providing storage locations for the critical tools needed to maintain operational effectiveness of the firing mechanism and maintenance of the "spit hole." The device provides permanent storage for the following tools:

a. "Spit hole" drill.

b. "Spit hole" brush.

c. Vent hole reamer assembly.

d. Primer seat cleaning brush.

e. Bottle of Cleaner, Lubricant, and Preservative (CLP).

The tools are located in a very accessible and convenient area for the cannoneer to use and replace them. This results in better maintenance of the firing components, increases firing rates, promotes safety, eliminates lost and/or misplaced tools, keeps tools clean and ready, and enhances mission effectiveness for crew survivability.

The device is semi-permanently attached, and thus being organic to the howitzer, travels with the howitzer through all it's missions. This permits the cannon crew to always know where their tools and primers are, and they are ready at a moments notice for firing.

The device is covered by a canvas cover (or similar suitable material) which keeps the contents free from gross contamination and dirt while mounted on the howitzer. The cover is quickly employed and stowed via quick release buckles and straps and can be readily contained on the side of the device during operational use. This cover has sufficient room to allow traveling with primers stowed in their appropriate carrier positions. All tool storage tubes may have holes drilled in the bottom most point to facilitate drainage of any water and permit easy cleaning.

DETAILED DESCRIPTION OF THE PREFERRED EMBODIMENTS

Figure 1:
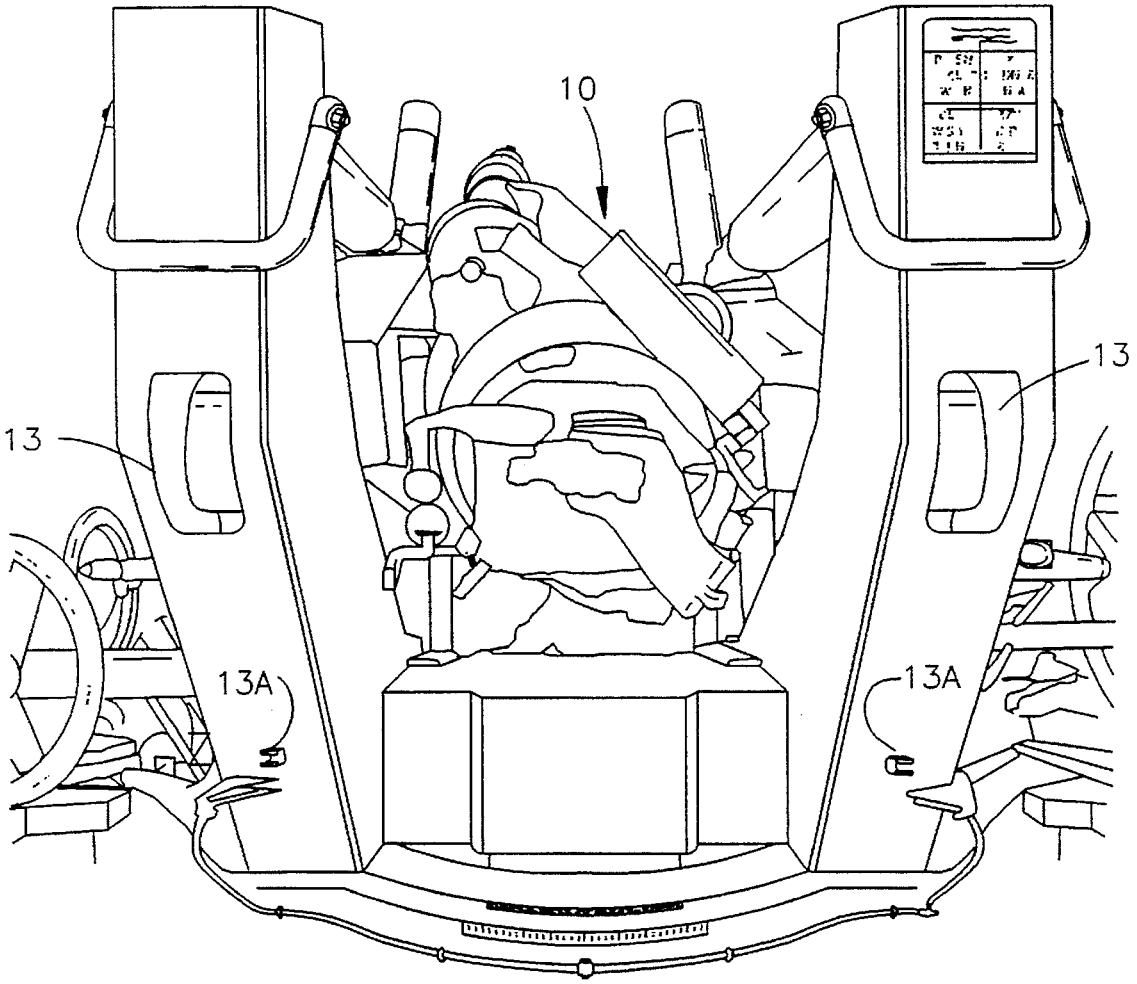
FIG. 1 is a rear perspective view of a portion of a cannon showing a trunnion mount tunnel and trunnion drain hole which cooperate to support a primer and tool holder configured in accordance with the principles of the present invention.
Figure 2:
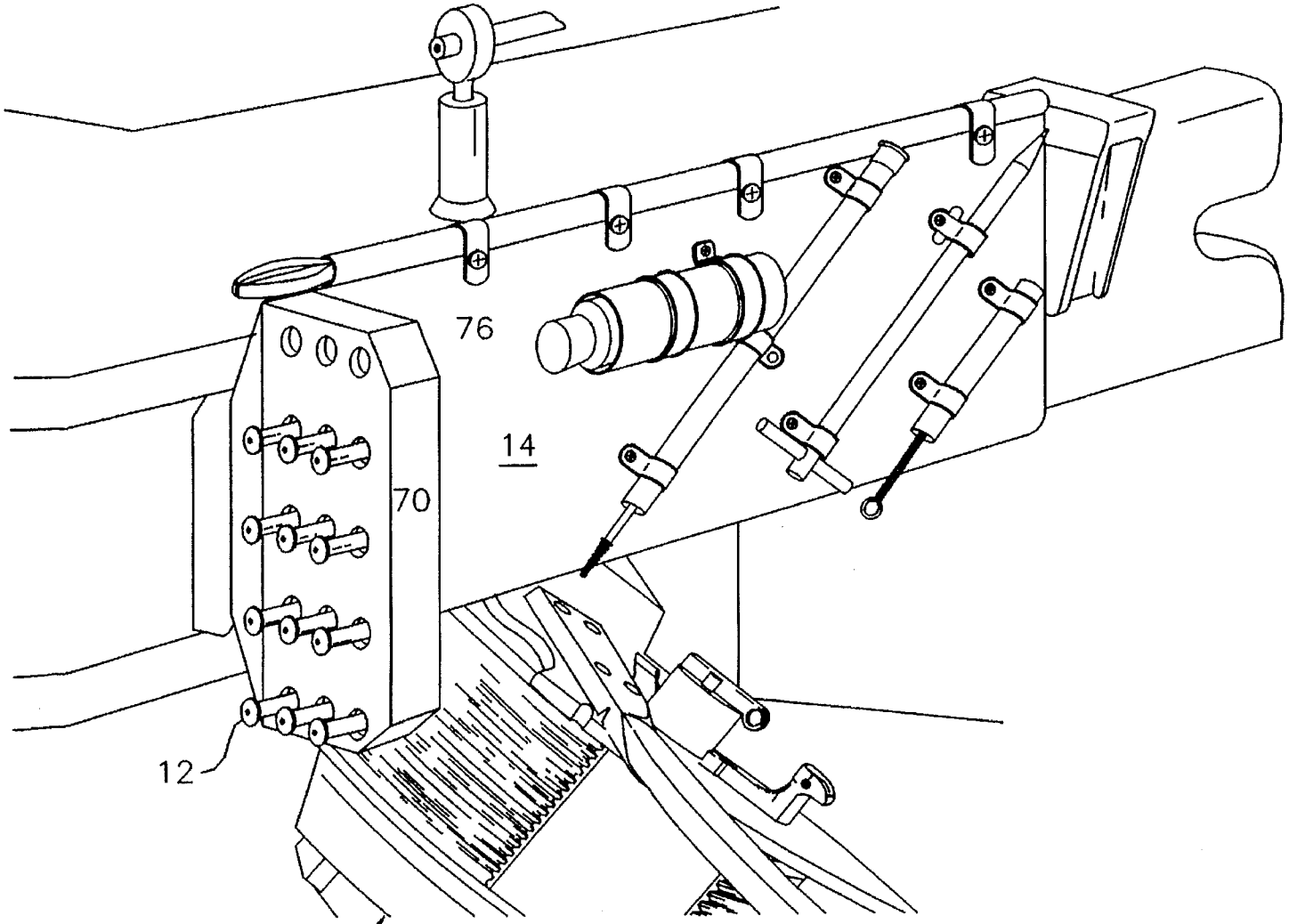
FIG. 2 is an enlarged rear perspective view of the cannon showing the primer and tool holder mounted thereon.

Referring now to FIG. 1, there is shown a cannon 10 which may be, for example, a M198 towed howitzer, a M109 series self propelled howitzer, a M110 series heavy howitzer, a M107 howitzer or other such cannon fired by a primer mechanism. The cannon 10 fires a semi-fixed powder charge in which the projectile and powder charges are separate components (not shown). To ignite the powder charge, a primer 12 (see FIG. 2) is fired. The primer 12 is similar to a small shotgun-like cartridge and is inserted into the breech of the cannon 10.

Referring now to FIGS. 1–5, since the cannon 10 may be fired repeatedly, a number of primers 12 may be located in close proximity to the cannon. According to the present invention, one trunnion mount tunnel 13 (FIG. 1) and trunnion drain hole 13*a* (FIG. 1) are used to detachably mount a primer and tool holder 14 on the cannon 10. This is accomplished by a coupling 16 which is received in one of the trunnion mount tunnels 13. A locking lug 19 (see FIG. 12), operated by a locking lug handle 19*a*, secures the bottom of the primer and tool holder 14 to the trunnion tunnel drain hole 13*a* of the cannon 10.

Figure 4:
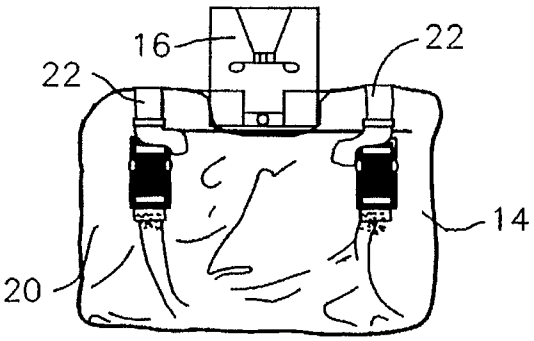
FIG. 4 is a top plan view of the primer and tool holder and cover of FIG. 2.
Figure 3:
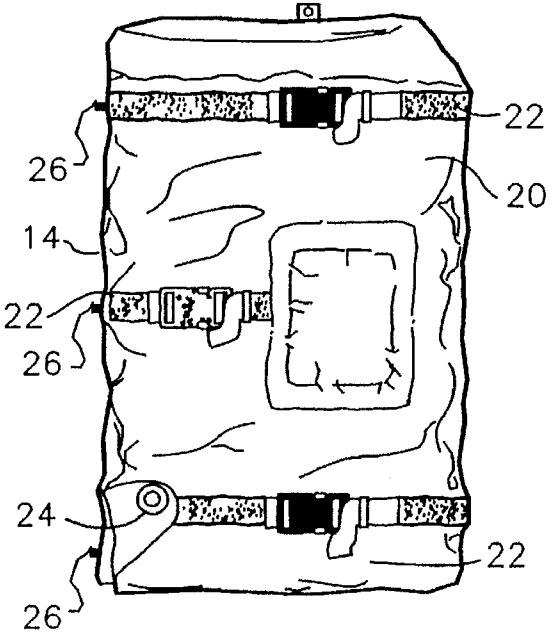
FIG. 3 is a front elevational view of the primer and tool holder of FIG. 2 with a cover thereover.
Figure 5:
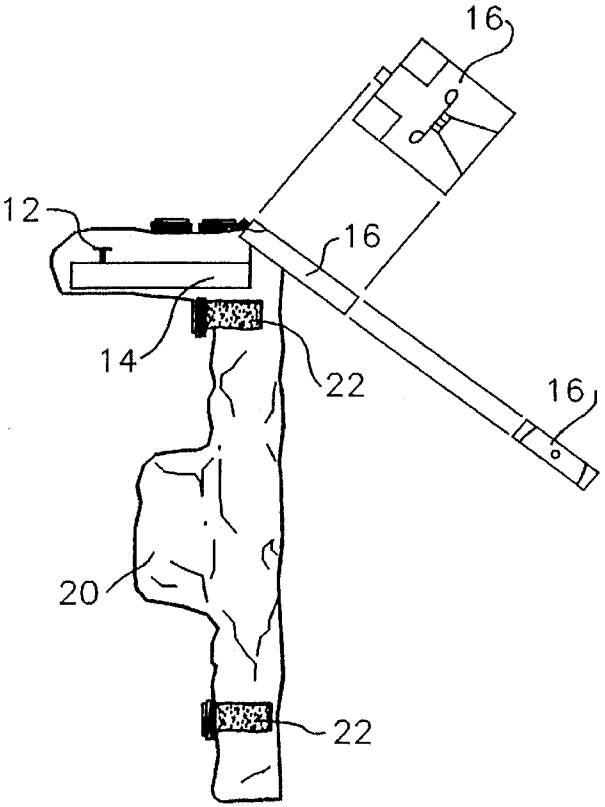
FIG. 5 is a side elevational view, partially in section of the primer and tool holder and cover of FIG. 2.

As is seen in FIGS. 3–5, when the cannon 10 is not being fired, the primer and tool holder 14 is wrapped in a waterproof cover 20. The waterproof cover 20 is secured around the primer and tool holder 14 by straps 22 including quick release and adjusting buckles and eyes 24 which receive pins 26 projecting from the primer and tool holder 14. The coupling 16 is normally uncovered, and as seen in FIG. 5, projects from the primer and tool holder 14 at a 45 degree angle according to the preferred embodiment. Of course, other appropriate angles may be used.

Referring now to FIGS. 6–9, it is seen that coupling 16 is retained in trunnion mount tunnel 13 by first sliding the coupling to hook over the edge 30 of the tunnel. The coupling 16 is comprised of an expandable locking wedge 32 made of delrin plastic or similar suitable material and having a first arm 34 and a second arm 36. Arms 34, 36 have converging surfaces 38, 40 between which is disposed a trapezoidal cam 42. The cam 42 has surfaces 44 and 46 which complement surfaces 38, 40. The cam 42 is mounted threadably to a screw 48 which is received in a threaded bore 50 of the cam.

Figure 8:
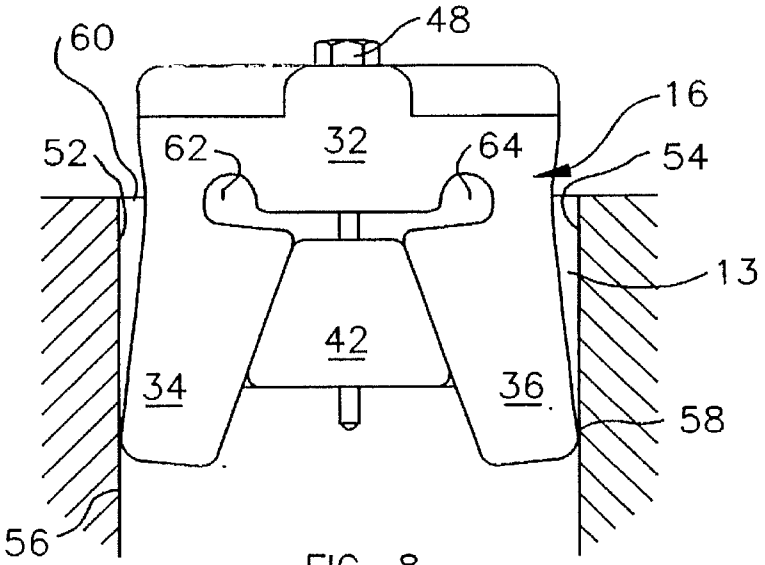
FIG. 8 is a view similar to FIG. 6 but showing the coupling locked to the trunnion mount tunnel.
Figure 6:
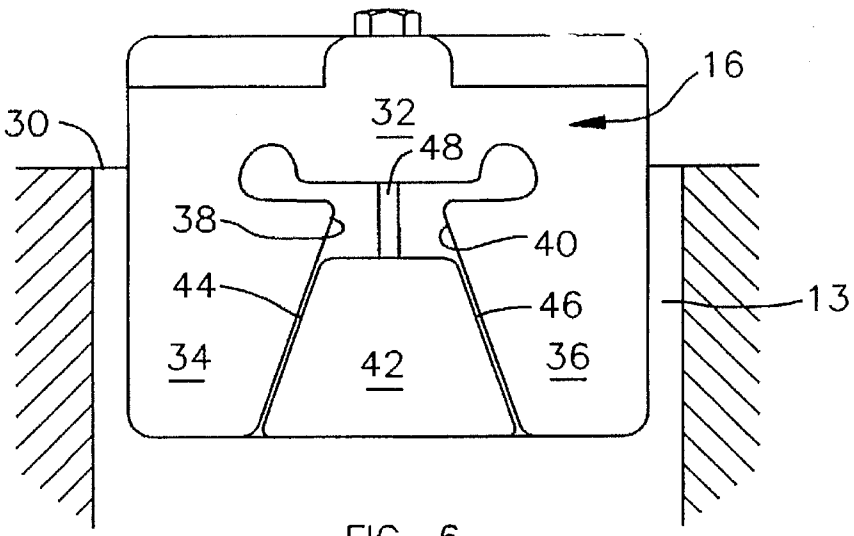
FIG. 6 is a top plan view of a portion of the trunnion mount tunnel and a coupling for locking the primer and tool holder in the trunnion mount tunnel, showing the coupling in the unlocked mode.

Upon rotating screw 48, cam 42 moves from its position in FIG. 6 to the FIG. 8 position in which walls 44 and 46 of the cam 42 engage the walls 38 and 40 of the block 16 expanding the arms 34 and 36 so as to engage the walls 52 and 54 of the trunnion mount tunnel 13. The engagement causes contact at areas 56 and 58 of the wall of the tunnel 13 disposed within the opening 60 of the tunnel. To facilitate flexing of arms 34, 36 of locking wedge 32, the retaining block has relieved portions 62, 64 therein.

Figure 9:
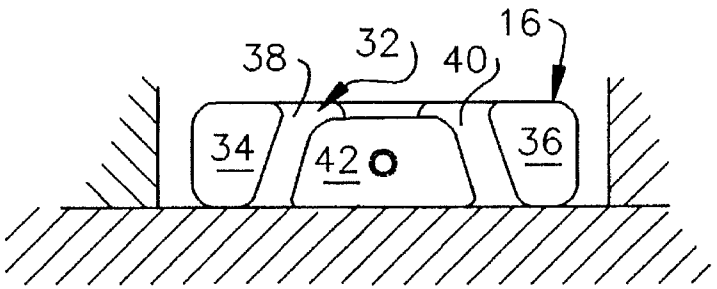
FIG. 9 is a view similar to FIG. 7 but showing the coupling locked to the trunnion mount tunnel.
Figure 7:
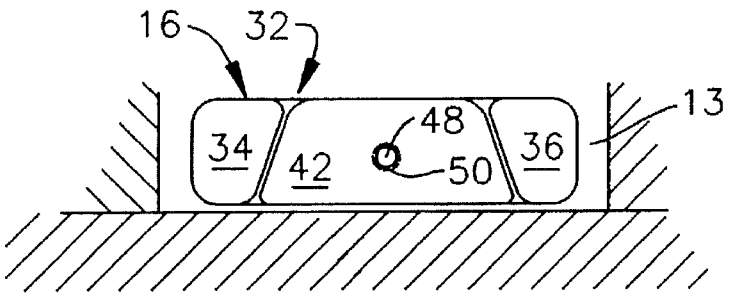
FIG. 7 is a rear elevational view of the coupling of FIG. 6.

As is seen in FIGS. 7 and 9, walls 38, 40 of locking block 32 and walls 44, 46 of cam 42 are slightly beveled so that as cam 42 is drawn from the FIG. 7 to the FIG. 9 position, legs 34, 36 advance slightly toward the opening 60 of trunnion mount tunnel 13. This helps to positively secure coupling 16 in tunnel 13 so that it is not dislodged upon firing the cannon 10 (see FIG. 1).

Figure 12:
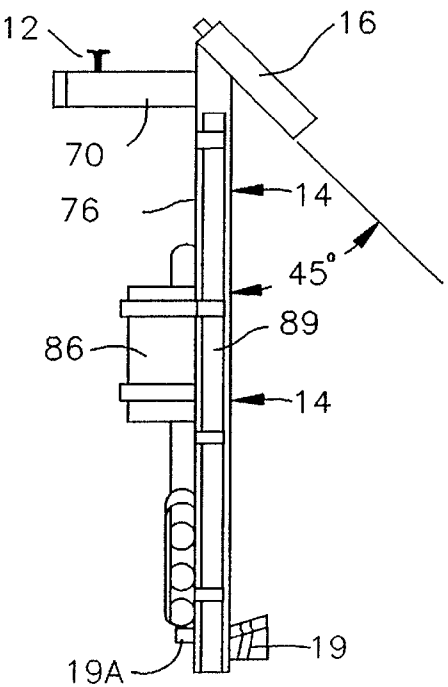
FIG. 12 is a side view of the primer and tool holder of FIG. 2.
Figure 10:
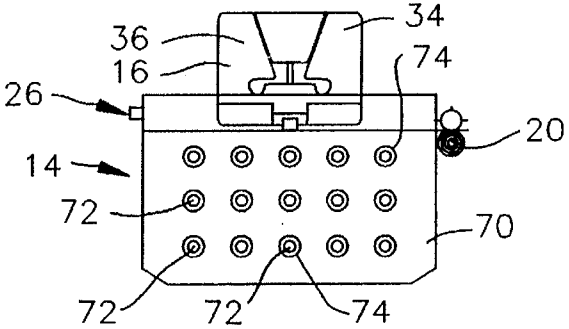
FIG. 10 is a top view of a primer and tool holder showing a primer tray and the coupling of FIG. 2.
Figure 11:
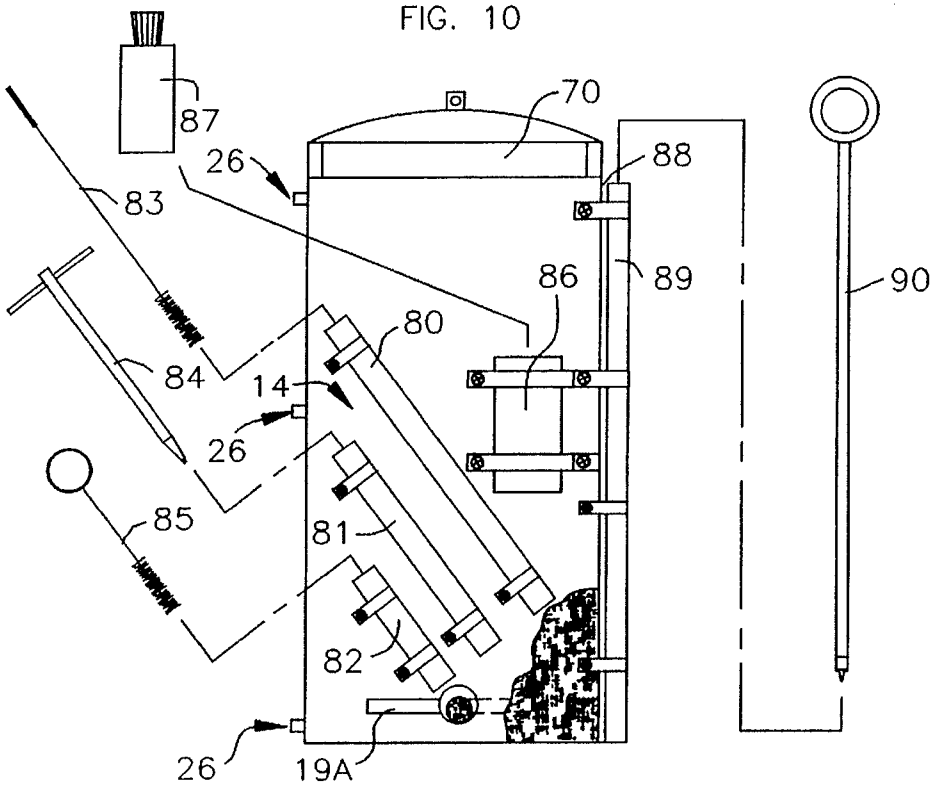
FIG. 11 is a front view of the primer and tool holder of FIG. 2 including a tool mounting plate.

Referring now to FIGS. 10–12, and initially, more particularly to FIG. 10, there is shown an article carrier or tray 70 which is about 3½ inches wide, 7½ inches long and one inch thick according to the preferred embodiment. Tray 70 may have about fifteen circular, straight wall, through holes 72 therein, each through hole retaining one primer 12. The through holes 72 are slightly bevelled at top 74 thereof so that primers 12 may be easily inserted and removed easily therefrom. Tray 70 projects from a base 76 which provides the primer and tool holder 14 with an inverted L-shaped configuration (see FIG. 12).

Base 76 has three tubes 80, 81, 82 mounted thereon which receive a spit-hole brush 83, a vent hole reamer 84 and a primer chamber brush 85 therein. Each tube has a closed bottom with at least one drain hole so that the implements do not pass therethrough. In addition, a vertically disposed, circular bottle containing tube 86 is mounted on the base 76 to hold a cleaner, lubricant, protectant "CLP" bottle 87. Disposed along a vertical edge 88 of base 76 is a relatively long vertical tube 89 which retains a spit-hole drill 90. Thus, all of the tools, which are necessary to service the vents and primer structure of cannon 10, are retained at one location so as to be conveniently available.

The primer and tool holder 14 is secured on one of the trunnion mounts which include trunnion mount tunnel 13 and drain hole 13*a* of cannon 10. This is accomplished by placing base 76 against the breech side wall of either trunnion mount of the cannon and concomitantly inserting locking wedge 32 into the trunnion mount tunnel 13. Next, lock mechanism 19 of the base 76 is inserted into the drain hole 13*a* of the trunnion mount and slightly tightened by rotating the handle 19*a*. The threaded bolt 48 is then tightened by being rotated which draws the cam 42 forward to spread arms 34, 36 so as to bear against walls 52, 54 of the trunnion mount tunnel 13.

The cam 42 in addition to being trapezoidal in shape, has angled walls 44, 46 which correspond to complementary angles on the walls 38, 40 of locking wedge 32. These angles trap locking wedge 32 within arms 34, 36 while at the same time exerting a downward pressure on trunnion tunnel 13. This results in an upward pressure on the base 76 securing the primer and tool holder 14 soundly to the trunnion mount. The base locking mechanism 19 is then completely tightened in the trunnion drain hole 13*a* to securely fasten the primer and tool holder 14 to the howitzer.

Once the primer and tool holder 14 has been mounted on the trunnion, the primers 12 are inserted into the holes 72 and the tray 70. Since the through holes 72, which hold the primers 12 have straight walls, i.e., not tapered, obstruction around the exit opening 74 (opposite from bevel) is minimized. In the unlikely event of premature primer detonation, the charge would not be contained and would fire in an non-explosive manner, thus eliminating the possibility of shrapnel. Since walls of the through holes 72 cover the entire perimeter of the charge area of the primer 12, a detonated primer cannot explode laterally and cause sympathetic detonation of adjoining primers. Since through holes 72 have straight walls, the primers 12 are held securely enough to preclude accidental loss, yet easy withdrawal is provided because there is space between the projecting primers for the artilleryman's fingertips. The straight walls of the holes 72 grip the generally tapered primers 12 and position the base of each primers above the tray 70 with sufficient grip area for easy grasping and removal.

Once primers 12 have been installed in tray 70, other tools, 83, 84, 85, 87 and 90 are placed in their appropriate storage tubes and the primer and tool holder 14 is ready for use with the cannon 10 when the cannon is fired. Upon cessation of firing, the canvas cover 20 is re-deployed and secured with straps 22 to protect the primers 12 and tools 83–90 from the elements. After covering with the canvas cover 20, the primer and tool holder 14 is ready for operational moves, road marches and airlifts.

The invention may be easily modified to mount on other guns and howitzers by adapting the mounting platforms and devices to fit the unique structures organic to each different model of weapon. The most important feature of the invention is locating the primers and tools close enough to the cannoneer on the weapon for ease of use. For example, an alternate mounting mechanism of the invention is used for the M109 self propelled howitzer, which omits the above described wedge coupling mechanism, as the primer and tool holder is bolted to the ceiling of the turret.

Preferably, the straight walled throughholes holding the primers are drilled at a 10°–15° angle above horizontal. The angle retains the primers in the article carrier or tray. The article carrier is articulated so the holder may be stowed (folded) flush against the base plate to minimize any unnecessary protuberance into the turret. In the M198 embodiment of the invention, the straight wall through holes are formed normal to the top surface of the article carrier, whereas the M109 version has the straight wall through holes formed at an acute angle with the top surface of the article carrier. The preferred arrangement for both embodiments includes a slight peripheral beveled edge proximate to the top surface to facilitate insertion of the primers into the article handler.

Figure 14:
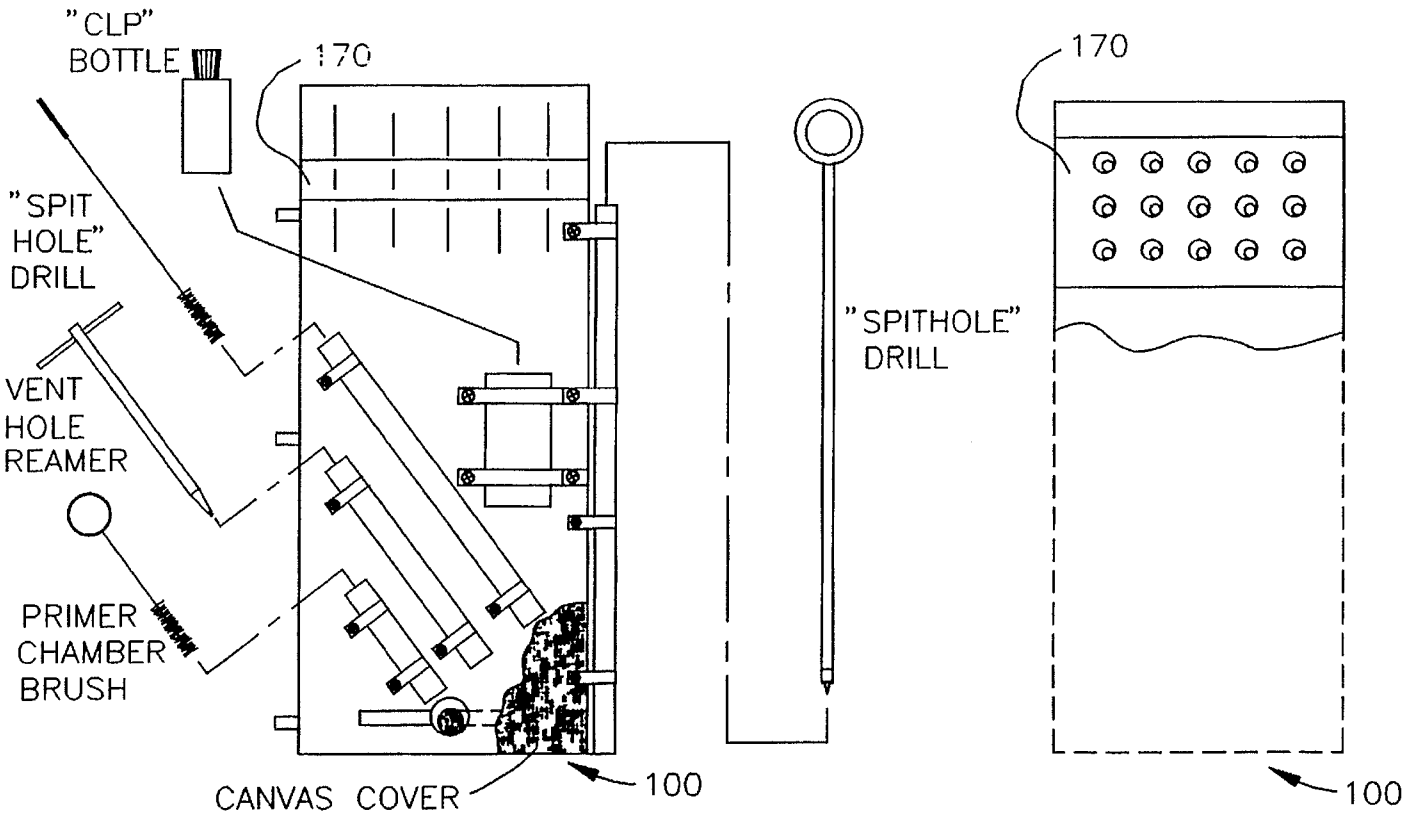
FIG. 14 is a bottom view of the alternate embodiment of a primer and tool holder of FIG. 13 in a first operational position and a second stowed position.
Figure 13:
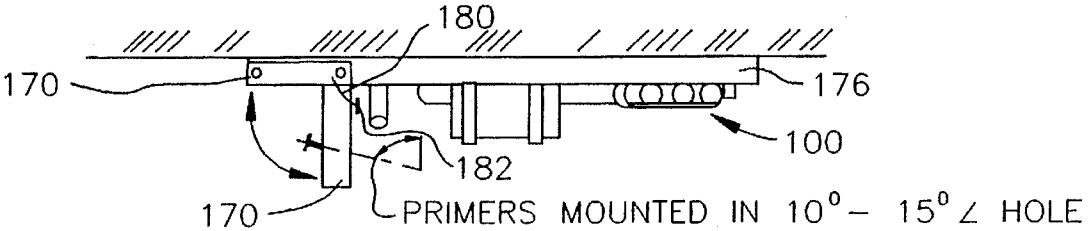
FIG. 13 is a side view of an alternate embodiment of a primer and tool holder according to the present invention.

FIGS. 13 and 14 show the alternate embodiment 100 of the primer and tool holder. Article carrier or tray 170 is articulated and pivots between 1) a stowed position substantially parallel to base 176 and 2) an operational position substantially perpendicular to base 176. A locking mechanism such as a ball lock pin 182 may lock the tray 170 in the stowed and operational positions. The locking mechanism is connected to the holder by a tether 180, which prevents the locking mechanism from being lost or misplaced. The M109 self propelled howitzer has at least one hand hold bolted to the ceiling of the turret section. The alternate embodiment may be advantageously secured to the ceiling of the turret by using the existing bolt holes and sandwiching the holder between the ceiling and the hand hold.

From the foregoing description, one skilled in the art can easily ascertain the essential characteristics of this invention, and without departing from the spirit and scope thereof, can make various changes and modifications of the invention to adapt it to various usages and conditions.

I claim:

1. A holder for mounting on an artillery piece, the holder comprising:

a base for mounting on the artillery piece, the base exending in a first direction;

an article carrier attached to the base and extending laterally therefrom, said article carrier having a plurality of holes therein for receiving explosive primers utilized with the artillery piece;

means for removably attaching the base to the artillery piece;

means on the base for supporting a plurality of tools for use with the artillery piece; and at least one primer stored in said article carrier.

2. The holder of claim 1, wherein said means on the base for supporting a plurality of tools includes a plurality of storage tubes fixed to said base.

3. The holder of claim 2, further including a cover for covering the primers and tools mounted on the holder.

4. A holder for mounting on an artillery piece, the holder comprising:

a base for mounting on the artillery piece, the base extending in a first direction;

an article carrier attached to the base and extending laterally therefrom, said article carrier having a plurality of holes therein for receiving explosive primers utilized with the artillery piece;

means for removably attaching the base to the artillery piece;

means on the base for supporting a plurality of tools for use with the artillery piece, the supporting means including a plurality of storage tubes fixed to the base; and a cover for covering the primers and tools mounted on the holder wherein the cover is made of flexible material.

5. A holder for primers and tools for use with an artillery piece which requires primers for firing, said holder comprising:

a base having a coupler for coupling with a trunnion mount of the artillery piece and storage containers thereon for retaining tools for servicing the artillery piece;

an article carrier projecting laterally from the base and including a plurality of holes therein, each of said holes being dimensioned and configured to receive a primer.

6. The primer and tool holder of claim 5, wherein the coupling comprises at least an expandable locking wedge received in a tunnel located in the trunnion mount and is expanded by a cam advanced in said wedge so said wedge engages and locks with the wall of the tunnel.

7. The holder of claim 5, wherein said wedge comprises at least a pair of arms having opposed surfaces wherein the surfaces converge with respect to first and second directions, the first and second directions being orthogonal to one another, and wherein the cam includes surfaces complementing the surfaces of the arms wherein when the cam is advanced between the arms, the arms are spread and cammed in two directions for engaging the wall of the tunnel.

8. The primer and tool holder of claim 7, wherein the coupling is attached proximate a tray and a separate latch is positioned in spaced relation on the base for latching with the vent hole of the tunnel upon being rotated.

9. The primer and tool holder of claim 8 further including a cover for enclosing the primer and tool holder to protect the primers and tools stored thereon.

10. The primer and tool holder of claim 9, wherein portions of the primers project above the top surface of the tray to facilitate grasping of primers, the charge portion of the primers being protected by the walls of the holes which surround the primers thus minimizing the possibility of sympathetic explosions should one primer discharge.

11. The primer and tool holder of claim 5, wherein said article carrier is pivotally connected to said base.

12. The primer and tool holder of claim 11, further comprising a locking mechanism for locking said article carrier in at least one of a first stowed position and a second operational position.

* * * * *